United States Patent [19]

Ellingvag

[11] Patent Number: 4,704,051

[45] Date of Patent: Nov. 3, 1987

[54] OFFSHORE MULTI-STAY PLATFORM STRUCTURE

[76] Inventor: Nils A. Ellingvag, St. Georgs vei 61, 0280 Oslo 2, Norway

[21] Appl. No.: 821,555

[22] PCT Filed: Feb. 28, 1985

[86] PCT No.: PCT/NO85/00011

§ 371 Date: Nov. 25, 1985

§ 102(e) Date: Nov. 25, 1985

[87] PCT Pub. No.: WO85/04437

PCT Pub. Date: Oct. 10, 1985

[30] Foreign Application Priority Data

Mar. 28, 1984 [NO] Norway ..... 841226

[51] Int. Cl.[4] ..... E02B 17/00

[52] U.S. Cl. ..... 405/224; 52/152; 405/195

[58] Field of Search ..... 405/202, 203, 204, 224, 405/195; 52/146, 152

[56] References Cited

U.S. PATENT DOCUMENTS

| | | | |
|---|---|---|---|
| 3,284,972 | 11/1966 | Werner | 52/146 |
| 3,388,512 | 6/1968 | Newman | 52/152 |
| 3,636,716 | 1/1972 | Castellanos | 405/202 |
| 4,127,003 | 11/1978 | Vilain | 405/202 |
| 4,170,186 | 10/1979 | Shaw | 405/202 |
| 4,222,682 | 9/1980 | Vilain | 405/203 |
| 4,269,542 | 5/1981 | Mueller | 405/203 |
| 4,273,470 | 6/1981 | Blomsma et al. | 405/202 |
| 4,378,178 | 3/1983 | Roach | 405/224 |

*Primary Examiner*—David H. Corbin

*Attorney, Agent, or Firm*—Fleit, Jacobson, Cohn & Price

[57] ABSTRACT

An offshore, bottom supported platform structure including a tower structure of low bending stiffness which is laterally supported at several elevations by inclined, pre-tensioned stay cables. The tower structure is composed of a number of vertical columns whch at each stay elevation below the elevation of the uppermost one, are interconnected by horizontal bracing members. A method is disclosed for constructing such an offshore platform structure.

8 Claims, 8 Drawing Figures

OFFSHORE MULTI-STAY PLATFORM STRUCTURE

This invention relates to an offshore bottom supported platform structure comprising a vertical tower structure of low bending stiffness which is laterally supported at several elevations by inclined, pre-tensioned stay cables. The tower structure being of low bending stiffness entails the major part of any horizontal loading on the tower is transferred down to the sea bottom—or down to the platform foundations—as changes in the stay cables tension forces.

The invention describes the configuration of a tower structure feasible for such platform. Further, the invention includes a platform construction alternative where the tower is erected on a floating box-like foundation structure whereafter the completed platform is towed out to location and installed. The invention also may be used as a subsea well-head platform for large water depths.

In a structural sense, conventional, fixed platforms like piled steel jackets and gravity platforms of concrete or steel are stiff tower structures spanning from the sea bottom up above the sea surface. For such structures the environmental loads are transferred down to the platform foundations as sear and bending forces in the structure. With increasing water depth the size and weight of such conventional platform structures increase dramatically. The structurally weight of a conventional steel jacket platform increases approximately in proportion to the square of the increase of the water depth. The reasons are the environmental loads acting on the platform increase in proportion to the size of the structure, while the bending moments at the platform foundations produced by said loads further increase with increasing height of the structure. Exploitation of hydrocarbons and other resources at increasing water depths implies a need to identify more efficient and appropriate concepts for offshore platform structures than those in use today. The disclosed invention represents such a concept.

Figure 1:
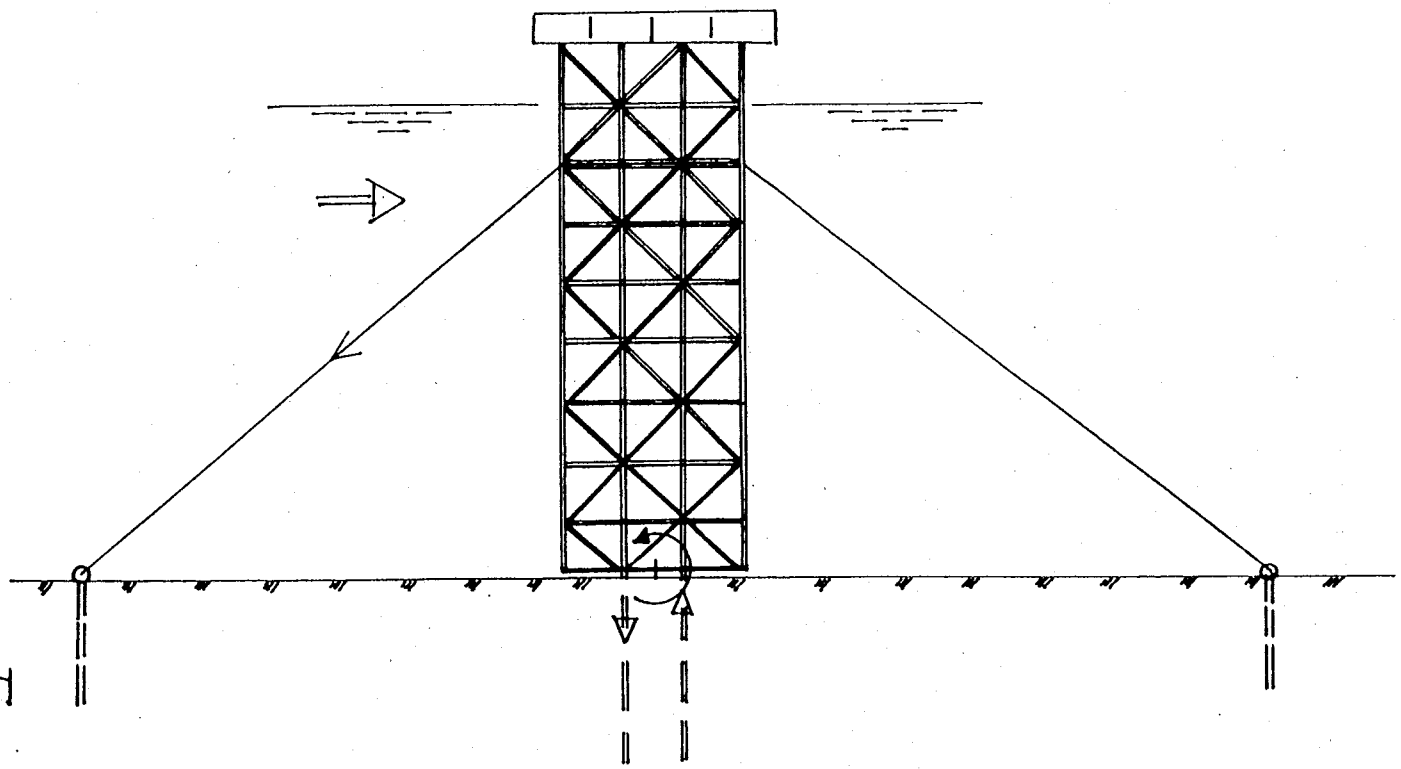
Fig. 1. PRIOR ART

Guyed towers used as offshore platform structures have been proposed earlier. This previously proposed structure—Exxon's 'Guyed Tower' (FIG. 1)—comprises a steel jacket structure which is laterally stayed at one single elevation some distance below the sea surface by means of inclined, pre-tensioned guy lines. All the guy lines have the same length and inclination and are attached to anchorages at the sea bottom. The jacket structure may be founded on piles or on a gravity 'spud can' foundation penetrated into the sea floor.

Horizontal loads acting on the 'Guyed Tower' platform will in part be balanced by changes in the guy line tension forces. However, the tower still needs to have significant bending stiffness as it spans from the sea bottom up to the elevation where the guy lines are attached. The requirement for bending stiffness limits the acceptable horizontal deflections of the tower; reducing the efficiency of the guy line stay arrangement. In a structural sense the 'Guyed Tower' platform is a stiff tower structure.

Concepts for offshore platform structures which do not make use of inclined stay arrangements, do not affect the invention presented here.

Figure 2A:
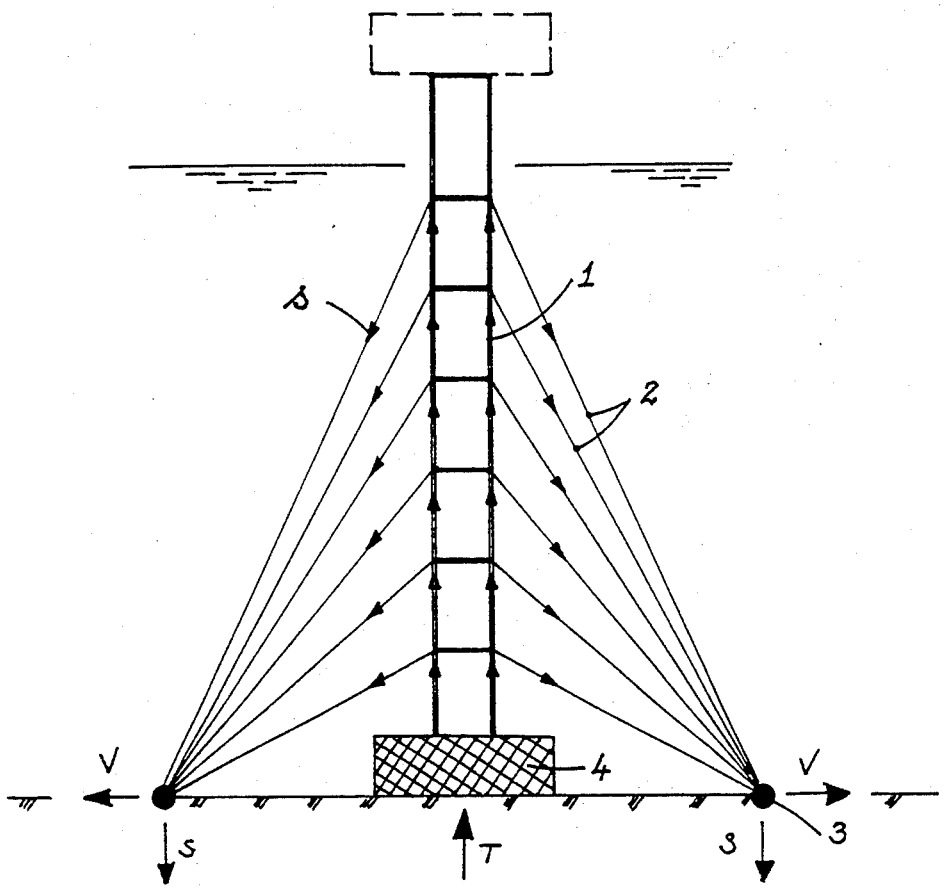
Figure 2B:
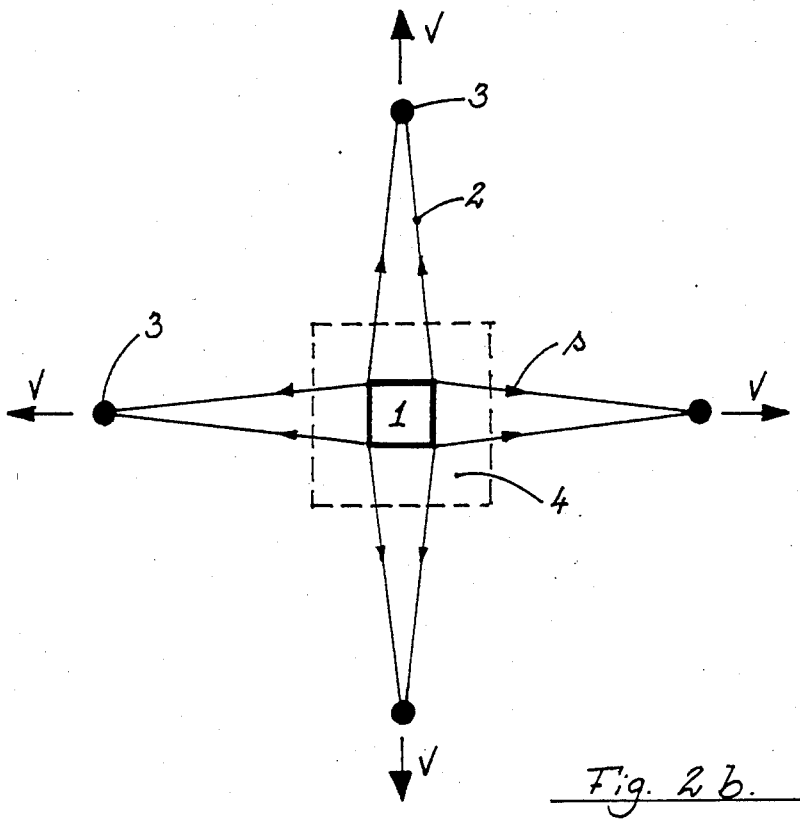

The main structural configuration of the platform invention disclosed here is sketched on FIG. 2*a*. FIG. 2*b* shows a plan view of the structure. The platform structure comprises a vertical tower 1 which is laterally supported at a number of elevations by means of inclined stay cables 2. The stay cables are pretensioned to a level which excludes slack in any cable for extreme environmental loading on the platform. The pre-tensioning of the stay cables introduces a compressive force T into the tower. The stay cbles 2 are attached to the stay anchorages 3; the horizontal and vertical components of the resultant anchorage forces due to cable pre-tensioning are denoted V and S. The platform tower 1 may be founded on piles or on a boxlike foundation structure (gravity type platform). The stay anchorages 3 may be integrated into the tower foundation 4.

Figure 3:
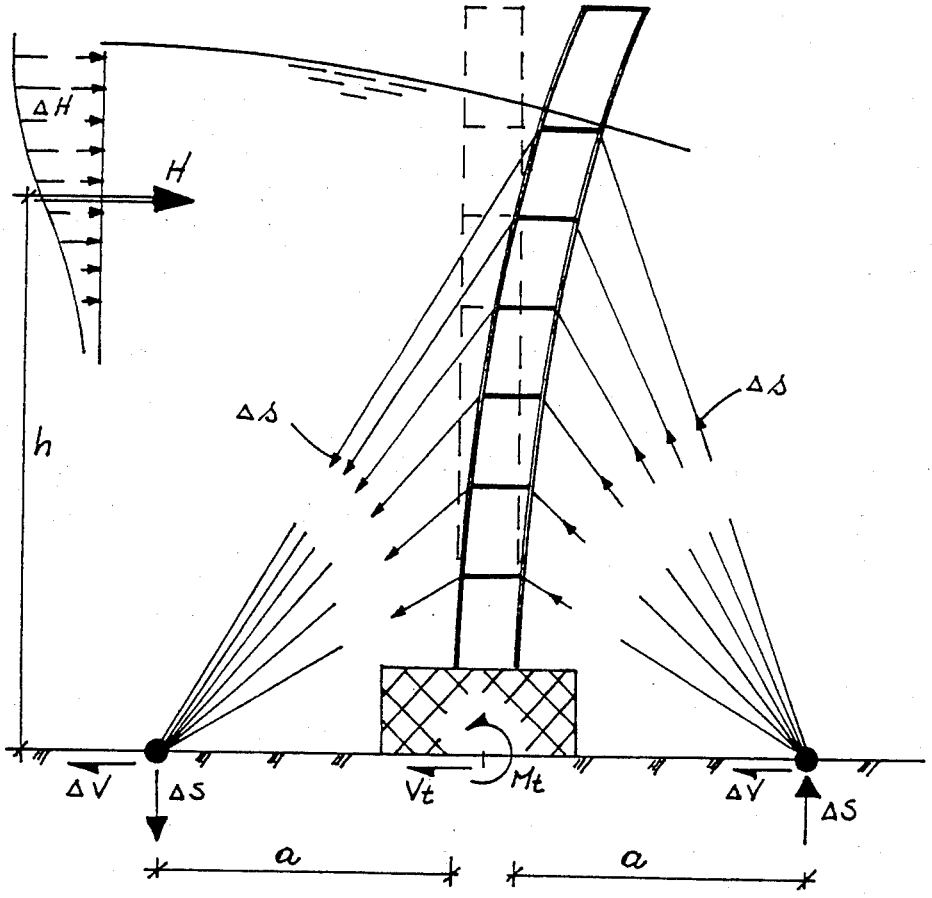

FIG. 3 illustrates the load carrying principles of the proposed structure. When the structure is exposed to a horizontal environmental load ΔH at a height h above the sea floor with the resultant H, the tower deflects which introduces the changes Δs of the stay cable forces. The related changes of the stay anchorage forces are denoted ΔS, at a distance a from the tower, and ΔV. The deflection of the tower also introduces bending moments Mt and shear forces Vt in the tower itself; the magnitudes of these two contributions being functions of the tower bending stiffness.

Force equilibrium of the structure is expressed by:

a. Overturning moment equilibrium:

$$H \cdot h = 2a \cdot \Delta S + Mt$$

b. Horizontal force equilibrium:

$$H = 2 \cdot \Delta V + Vt$$

The horizontal force H does not cause any change of the tower compressive force T.

With respect to offshore platform structures, the disclosed multi-stay arrangement of inclined cables represents a new system for carrying loads. The tower structure now mainly is the compressive chord member of a structural system where the horizontal forces are carried by the inclined stay cables. Similar to the chord of a truss, the compressive chord member does not need much bending stiffness. Any significant bending stiffness of the tower structure is also not desired since this will reduce the efficiency of the stays and increase the stresses in the tower. Pre-tensioning of the stay calbes introduces considerable compressive forces into the tower; hence, safety against buckling will govern the tower structural design.

The tower deflection curvature for horizontal loading is controlled through adjusting the longitudinal stiffness (i.e the cross sections) of the individual stay cables. The disclosed platform will have superior qualities with respect to dynamic behaviour due to the large amount of system damping in a multi-stay arrangement of cables of different lengths and inclinations.

The tower bending stiffness is of paramount importance for the proposed multi-stay platform. The ratio between the tower bending stiffness and the longitudinal stiffness of the stays cna be expressed as:

$$K = \frac{Eo \cdot Io}{l^2 \cdot Ec \cdot Ac}$$

where:

Eo Io = tower bending stiffness

Ec Ac = longitudinal stiffness of the stay cables $l$ = height of the tower.

Large values of K mean the structure primarily will behave like a stiff tower structure, the effect of the stays being correspondingly low. Low values of K represent a platform structure for which horizontal loads primarily are carried by the stay cables, implying correspondingly low bending stresses in the tower structure.

Figure 4:
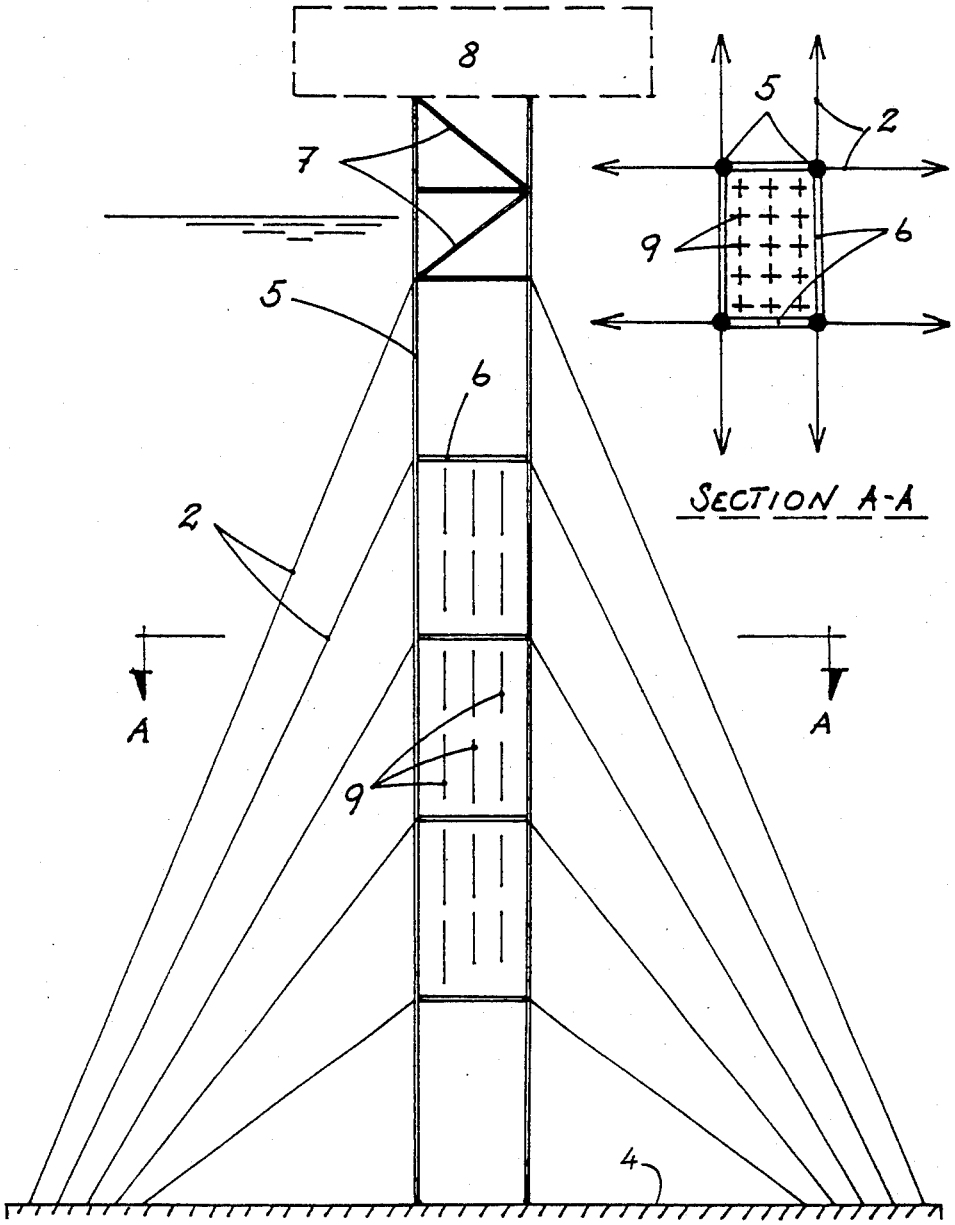

FIG. 4 shows the structural configuration of a tower which allows near optimum flexibility with respect to tower bending stiffness while at the same time sufficient safety against buckling of the tower structural members is ensured.

The tower structure comprises a number of vertical columns 5 which at each stay elevation are interconnected by means of only horizontal bracing members 6. The tower bending stiffness is adjusted by adjusting the bending stiffness of the horizontal bracing members. Above the elevation of the uppermost stay attachment the tower bending stiffness is increased by means of cross bracings 7 so as to reduce the horizontal deflections of the platform topside structure 8. It might be beneficial to strengthen also the upper part of the tower just below the uppermost stay elevation by cross bracings so as to obtain a more even distribution of stay cable forces. However, for the structural system disclosed here it is imperative that the tower horizontal deflections are governed by the longitudinal stiffness, of the stay cables not by the tower bending stiffness.

The elevation of the uppermost stay attachment should be as close to the top of the tower as possible as this will reduce the tower bending stresses. Practical considerations, e.g. the traffic of boats close to the platform as well as the risk of dmage to the stay cables, imply the elevation of the uppermost stay is some distance below the sea surface.

The tower configuration may easily be adapted to accommodate well conductors, riser pipes and any other installation 9 related to the platform function. The vertical distance between the stay elevations—and hence between the horizontal bracing members 6—may practically be chosen from the need for lateral support to the conductors and riser pipes. (This implies from 20 m to 40 m vertical distance between the stay elevations). The environmental loads acting on the conductors and risers then are transferred to the tower at the stay elevations.

Figure 4A:
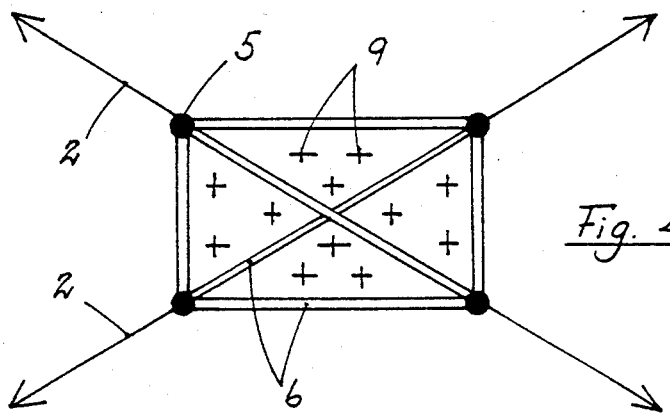

FIG. 4, Section A—A shows a tower structure comprising four vertical columns 5, each column being stayed in two horizontal directions. The stays in the same horizontal direction need not converge at the same stay anchorage 3 on horizontal foundation line 4, as in the embodiment shown on FIG. 2*b*. *FIG. 4a* shows a tower structure which is stayed diagonally by one horizontal stay direction to each column. At the stay elevations the columns 5 are interconnected also by means of diagonal bracing members.

Alternatively, each single column may be stayed in three—or preferably four—horizontal directions. For such arrangement, horizontal loads on the tower do not at all introduce any compressive forces into the tower columns.

The above examples just illustrate some of the possible stay arrangements. Practicl considerations and costs will determine which stay arrangement is the most feasible for each specific case.

Figure 5:
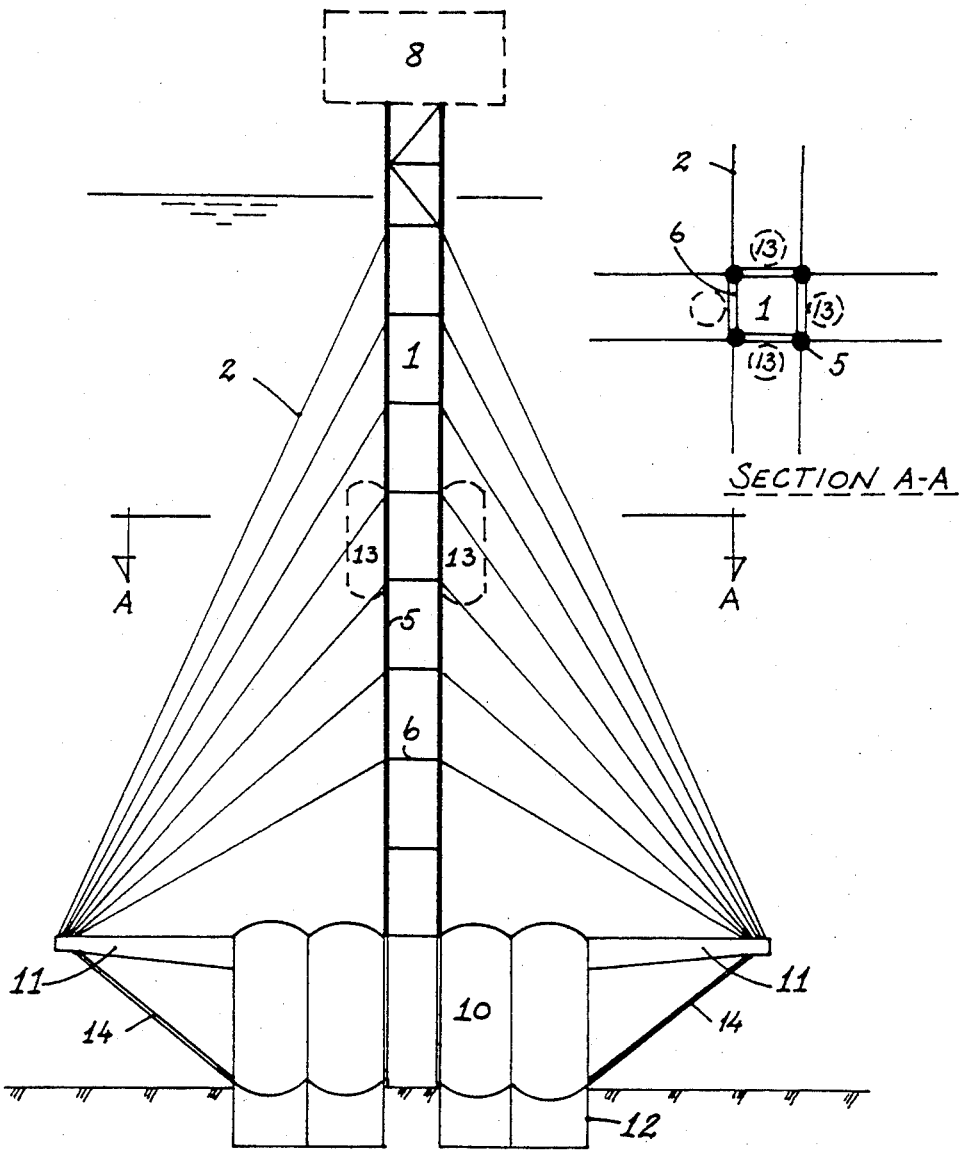

FIG. 5 shows a gravity platform version of the invention. The platform structure can be completed in inshore waters before it is towed out and installed. The tower 1 is erected on top of a floating box-like foundation structure 10. The stays are installed and the stay cables tensioned consecutively following the erection of the tower structure. To increase the inclination of the stays they are anchored to arms 11 cantilevering out from the foundation structure 10. The cantilevering arms 11 are braced to the base of the foundation structure by means of inclined bracing members or stays 14.

Upon completion of the the tower erection the platform is towed to its final location and installed. The platform may be equipped with temporary buoyancy units 13 to ensure hydrostatic stability during the construction afloat and tow-out stages. The topside structure 8 may be lifted on after the platform structure has been firmly installed on the sea bottom. The platform foundation structure may be equipped with skirts 12 penetrating into the sea floor so as to improve the platform geotechnical safety.

Figure 6:
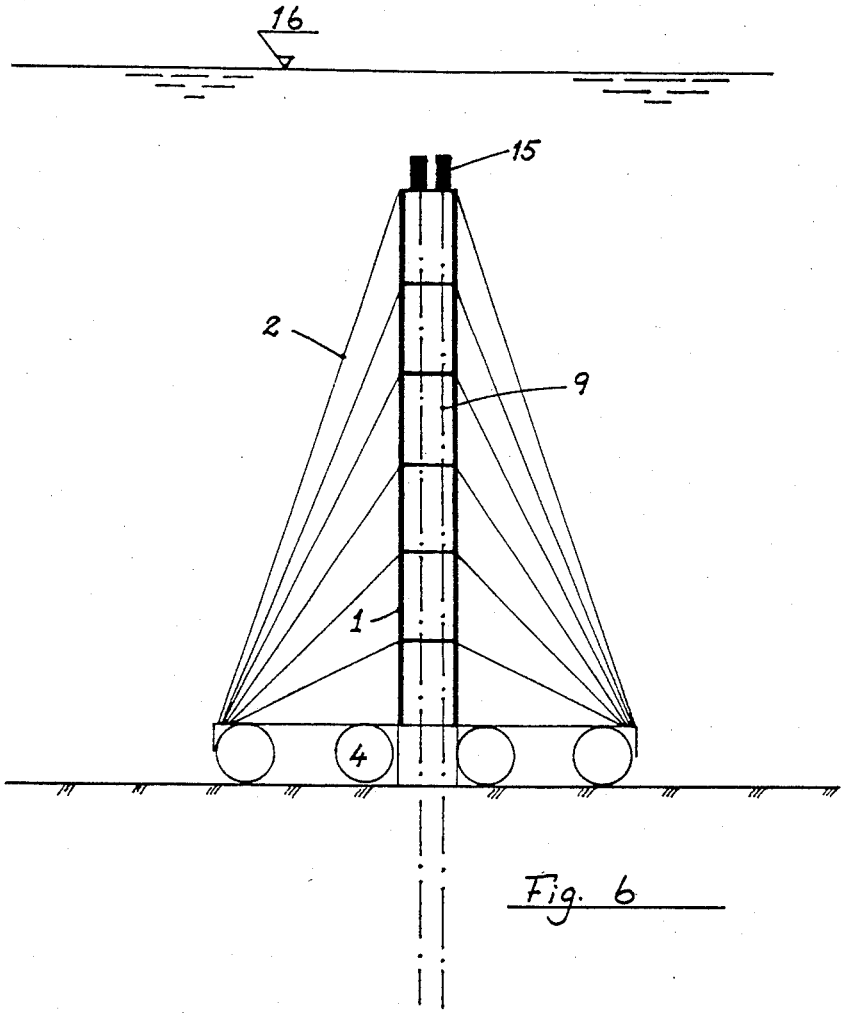

FIG. 6 shows the invention utilized for a subsea well-head platform for large water depths. The well-heads 15 are placed on top of the tower 1 which is discontinued some distance below the sea surface 16. By this approach the zone of maximum environmental load intensity is avoided, while the well conductors 9 are laterally supported by the tower for the larger water depths. Use of the invention as disclosed on FIG. 6 will simplify the riser and conductor problems related to floating production installations. The well-head platform may be supported on piles or on a gravity foundation.

The above examples do not exclude other potential applications of the disclosed invention.

I claim:

1. An offshore platform installation comprising:

a foundation structure located on the sea bottom;

a vertical tower structure supported on the foundation structure;

at least one vertical portion of the tower structure being composed of a plurality of vertical columns interconnected by horizontal bracing members located at various elevations of the tower structure; and a plurality of pre-tensioned stay cables arranged symmetrically around said tower structure and extending inclininglly from each of said plurality of vertical columns towards anchoring locations laterally outwardly spced in the foundation structure at substantial distances from the tower structure, the upper ends of the stay cables being connected to the tower structure at a plurality of the interconnections of horizontal bracing members with vertical columns.

2. An installation as claimed in claim 1, wherein the tower structure includes an upper tower portion above an uppermost stay connection elevation, the upper tower portion including columns braced by diagonal bracing members.

3. An installation as claimed in claim 1, wherein the tower structure includes four vertical columns, each column being laterally supported by stay cables connected to the columns in at least two vertically spaced planes.

4. An installation as claimed in claim 3, including diagonal horizontal bracing members interconnecting the columns at the stay cable connections.

5. An installation as claimed in claim 1, wherein the foundation structure includes outwardly extending cantilever members and the stay cables are anchored to end portions of the cantilever members.

6. An installation as claimed in claim 5, wherein the foundation structure includes a base and inclined bracing members extending from the base to the cantilever members.

7. An installation as claimed in claim 1, including conduit means for hydrocarbon products extending upwardly along the tower structure, and lateral supporting means for supporting the conduit means at each stay elevation of said tower structure.

8. An installation as claimed in claim 7, wherein said tower structure terminates at a distance below the sea surface elevation.

* * * * *